US010094054B1

(12) United States Patent
Fukui

(10) Patent No.: US 10,094,054 B1
(45) Date of Patent: Oct. 9, 2018

(54) STITCH-SIZE CONTROLLED KNIT PRODUCT

(71) Applicant: OKAMOTO CORPORATION, Kitakatsuragi-gun, Nara (JP)

(72) Inventor: Takao Fukui, Nara (JP)

(73) Assignee: OKAMOTO CORPORATION, Nara (JP)

( * ) Notice: Subject to any disclaimer, the term of this patent is extended or adjusted under 35 U.S.C. 154(b) by 0 days.

(21) Appl. No.: 16/047,059

(22) Filed: Jul. 27, 2018

Related U.S. Application Data

(62) Division of application No. 13/767,274, filed on Feb. 14, 2013, now Pat. No. 10,060,055.

(30) Foreign Application Priority Data

Feb. 15, 2012 (JP) ..... 2012-031155

(51) Int. Cl.
*D04B 1/26* (2006.01)
*A41B 11/00* (2006.01)
*D04B 1/10* (2006.01)

(52) U.S. Cl.
CPC ..... *D04B 1/26* (2013.01); *A41B 11/003* (2013.01); *D04B 1/102* (2013.01)

(58) Field of Classification Search
CPC . D04B 11/00; D04B 1/26; D04B 9/46; D04B 11/28; A41B 11/003; A41B 9/52
See application file for complete search history.

(56) References Cited

U.S. PATENT DOCUMENTS 5,787,732 A * 8/1998 Perron ..... D04B 1/243 2/401
7,996,924 B2 * 8/2011 Wright ..... A41D 13/0015 2/239
8,572,766 B2 * 11/2013 Shull ..... A41B 11/003 2/239
2003/0192351 A1 * 10/2003 Meckley ..... D04B 1/102 66/170
2009/0165190 A1 * 7/2009 Araki ..... A61F 13/064 2/240
2009/0276939 A1 * 11/2009 Sho ..... A41B 11/02 2/239

(Continued)

OTHER PUBLICATIONS

Fukui, "Stitch-Size Controlled Knit Product", U.S. Appl. No. 13/767,274, filed Feb. 14, 2013.

*Primary Examiner* — Danny Worrell
(74) *Attorney, Agent, or Firm* — Keating & Bennett, LLP

(57) ABSTRACT

A knit product includes a compression region and is formed by a circular knitting machine knitting first and second stitches having different stitch sizes in the same course. The second stitch has a smaller stitch size. The second stitch is selectively provided on a stitch-by-stitch basis. The knitting needles have a density of 14 to 24 per inch in a circumferential direction. A face yarn of a knitting yarn has a cotton count larger than 10. A back yarn of the knitting yarn is a covering yarn having a core yarn of polyurethane of 70 denier or less or a man-made fiber of 140 denier or less subjected to texturing. The size difference between the first and second stitches is 0.1 mm to 2.0 mm. The elongation difference between a first-stitch region of the first stitch and a second-stitch region of the second stitch is 20% to 100%.

2 Claims, 8 Drawing Sheets

(56) References Cited

U.S. PATENT DOCUMENTS

| | | | | |
|---|---|---|---|---|
| 2011/0314591 | A1* | 12/2011 | Mitsuno | A61F 13/08 2/239 |
| 2012/0024014 | A1* | 2/2012 | Fukui | D04B 1/102 66/171 |

* cited by examiner 201
311
202
306
234(203)
305
233(203)
304
232(203)
303
301
310
231(203)
307
302
323
322
321

STITCH-SIZE CONTROLLED KNIT PRODUCT

BACKGROUND OF THE INVENTION

1. Field of the Invention

The present invention relates to a stitch-size controlled knitted fabric in which a plurality of stitches are formed by a circular knitting machine and a stitch-size controlled knit product.

2. Description of the Related Art

A conventional tubular knitted fabric for clothing such as a leg wear is known in which a compression region having a lower elastic property than around the compression region is formed. For example, in a sock described in JP2000-303207(A), a compression region is formed by applying a tuck stitch or the like to make a knitting structure of the compression region different from that around the compression region.

In socks described in JP 61-043208(U) and JP 2011-074519(A), a compression region is formed by inserting elastic material such as rubber or motif yarn into the knitted fabric. In a sock described in JP 62-015327(U), the stitch size in the knitted fabric is made larger and smaller, and smaller stitches are arranged on a round-by-round basis to form a compression region.

Japanese Patent Publication No. 9-195104 discloses pantyhose provided with a clothing pressure difference in a wale direction by stitch portions having two or more different stitch sizes in the same course in at least a portion of a foot portion.

However, the aforementioned conventional techniques have problems. In accordance with the technique described in JP2000-303207(A), when a tuck stitch is applied in the compression region, the compression region is thicker and harder than another region of the knitted fabric around the compression region. Therefore, it is necessary to prevent the compression region from getting thicker and harder than around the compression region and to improve wearing comfort.

In accordance with the conventional techniques described in JP 61-043208(U) and JP 2011-074519(A), a cut yarn tail of a cut-boss pattern projects from a skin-side surface and may cause a person who wears a knit product made from that knitted fabric to have a feeling of strangeness that something exists. Therefore, it is necessary to improve wearing comfort.

In accordance with the conventional technique described in JP 62-015327(U), the compression region is formed on a round-by-round basis. Therefore, a portion which should not be compressed is also compressed unnecessarily.

In accordance with the conventional technique described in JP 9-195104, the stitch sizes are made different by using a stitch cam's operation. However, the stitch cam's operation cannot be controlled precisely on a stitch-by-stitch basis. The knitted fabric is required to have stitch sizes controlled on a stitch-by-stitch basis.

SUMMARY OF THE INVENTION

In view of the aforementioned problems, preferred embodiments of the present invention provide a knit product knitted to include a plurality of stitches of different stitch sizes in a same course on a circumference by selecting either one of large and small stitches on a stitch-by-stitch basis by selectively driving sinkers of a circular knitting machine. Preferred embodiments of the present invention also provide a stitch-size controlled knit product in which a compression region is formed by controlling and changing the stitch size on a stitch-by-stitch basis and wearing comfort is improved.

According to a preferred embodiment of the present invention, a stitch-size controlled knit product is provided. The knit product is formed by a circular knitting machine capable of forming a plurality of stitches of different stitch sizes in a same course on a circumference by moving sinkers in and out of between reciprocating knitting needles, wherein the plurality of stitches include a first stitch and a second stitch having a stitch size smaller than that of the first stitch. The circular knitting machine is capable of selectively arranging the second stitch on a stitch-by-stitch basis, and the knitting needles are arranged on a cylinder of the circular knitting machine preferably at a density of about 14 to about 24 per inch in a circumferential direction of the cylinder, for example. A yarn count of a face yarn of a knitting yarn forming the stitches preferably corresponds to a cotton count larger than 10, for example. A back yarn of the knitting yarn forming the stitches preferably is either one of covering yarn having a polyurethane core yarn of about 70 denier or less and a man-made fiber subjected to texturing of about 140 denier or less, for example. A size difference between the first stitch and the second stitch preferably is about 0.1 mm to about 2.0 mm, for example. An elongation difference between a first-stitch region defined by the first stitch only and a second-stitch region defined by the second stitch preferably is about 20% to about 100%, for example.

In the stitch-size controlled knit product described above, either one of the first stitch (larger stitch size) and the second stitch (smaller stitch size) can be selected and arranged on a stitch-by-stitch basis. Also, it is possible to form a compression region at a desired position by selectively arranging the first stitch and the second stitch in the same course on the circumference.

In a knit product according to a preferred embodiment of the present invention, it is possible to form the compression region by changing the stitch size. Therefore, the compression region can be prevented from being harder than around the compression region. Because in the knit product according to a preferred embodiment of the present invention the stitch size can be changed on a stitch-by-stitch basis, the area of the compression region can be appropriately set. Therefore, it is possible to set the compression region with avoiding a portion which should not be compressed.

The back yarn may be a covering yarn having a core yarn of polyurethane of about 10 denier to about 40 denier or be a man-made fiber subjected to texturing of about 70 denier to about 110 denier, for example. Also, the yarn count of the face yarn may correspond to a cotton count between 30 and 80, for example.

The stitch-size controlled knit product described above may further include a fastening portion having a stronger fastening force than around the fastening portion. In this case, the fastening portion is defined by the second-stitch region.

The stitch-size controlled knit product described above may further include a body portion arranged to cover at least an instep, a sole, and an ankle of a person who wears the stitch-size controlled knit product. The fastening portion may be arranged in form of an involuted spiral extending from the instep to the ankle through the sole, and may include a first fastening portion arranged to extend from the instep to the sole through an inside and a second fastening portion arranged in a ventral portion of the ankle from an outside to the inside obliquely upward to compress the ventral portion of the ankle in a plane.

The stitch-size controlled knit described above may further include a body portion arranged to cover at least an instep, a sole and an ankle of a person wearing the stitch-size controlled knit product, and the fastening portion may be arranged to extend from a ventral portion of the ankle thorough the instep and reach a base of a fifth toe.

In the stitch-size controlled knit product described above, the plurality of stitches may include a third stitch having a stitch size which is smaller than that of the first stitch and is larger than that of the second stitch. In this case, it is possible to provide a pressure difference in the compression region by the second and third stitches and to form a pattern by the second and third stitches.

According to another preferred embodiment of the present invention, a stitch-size controlled knit product is provided. The knit product is formed by a circular knitting machine capable of forming a plurality of stitches having different stitch sizes in a same course on a circumference by moving sinkers in and out of between reciprocating knitting needles. The stitches include a first stitch and a second stitch having a smaller stitch size than the first stitch. The circular knitting machine is capable of selectively arranging the second stitch on a stitch-by-stitch basis. The knitting needles are arranged on a cylinder of the circular knitting machine preferably at a density from about 14 to about 24 per inch in a circumferential direction of the cylinder, for example. A yarn count of a face yarn of a knitting yarn forming the stitches preferably corresponds to a cotton count larger than 10, for example. A difference of the stitch size between the first stitch and the second stitch preferably is from about 0.1 mm to about 2.0 mm, for example. An elongation difference between a first-stitch region formed by the first stitch only and a second-stitch region formed by the second stitch only preferably is from about 20% to about 100%, for example.

In the stitch-size controlled knit product described above, the first stitch (larger stitch size) and the second stitch (smaller stitch size) can be selected and arranged on a stitch-by-stitch basis. Moreover, in this stitch-size controlled knit product, it is possible to form the compression region at a desired position by selectively arranging the first and second stitches in the same course on the circumference.

According to the knit product of various preferred embodiments of the present invention, the compression region can be formed by changing the stitch size. Therefore, it is possible to prevent the compression region from being thicker and harder than around the compression region. Also, in the knit product of preferred embodiments of the present invention, it is possible to change the stitch size on a stitch-by-stitch basis. Therefore, the area of the compression region can be accurately set. Thus, the compression region can be set in a portion other than a portion which should not be compressed.

The yarn count of the face yarn may correspond to a cotton count between 30 and 80, for example.

According to various preferred embodiments of the present invention, a stitch-size controlled knit product can be provided in which either one of a large stitch size and a small stitch size is selected on a stitch-by-stitch basis by selective driving of sinkers of a circular knitting machine and therefore stitches of different stitch sizes are formed in the same course on the circumference. Moreover, according to various preferred embodiments of the present invention, a knit product can be provided which has a compression region formed by controlling and changing the stitch size on a stitch-by-stitch basis and which can provide improved wearing comfort.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
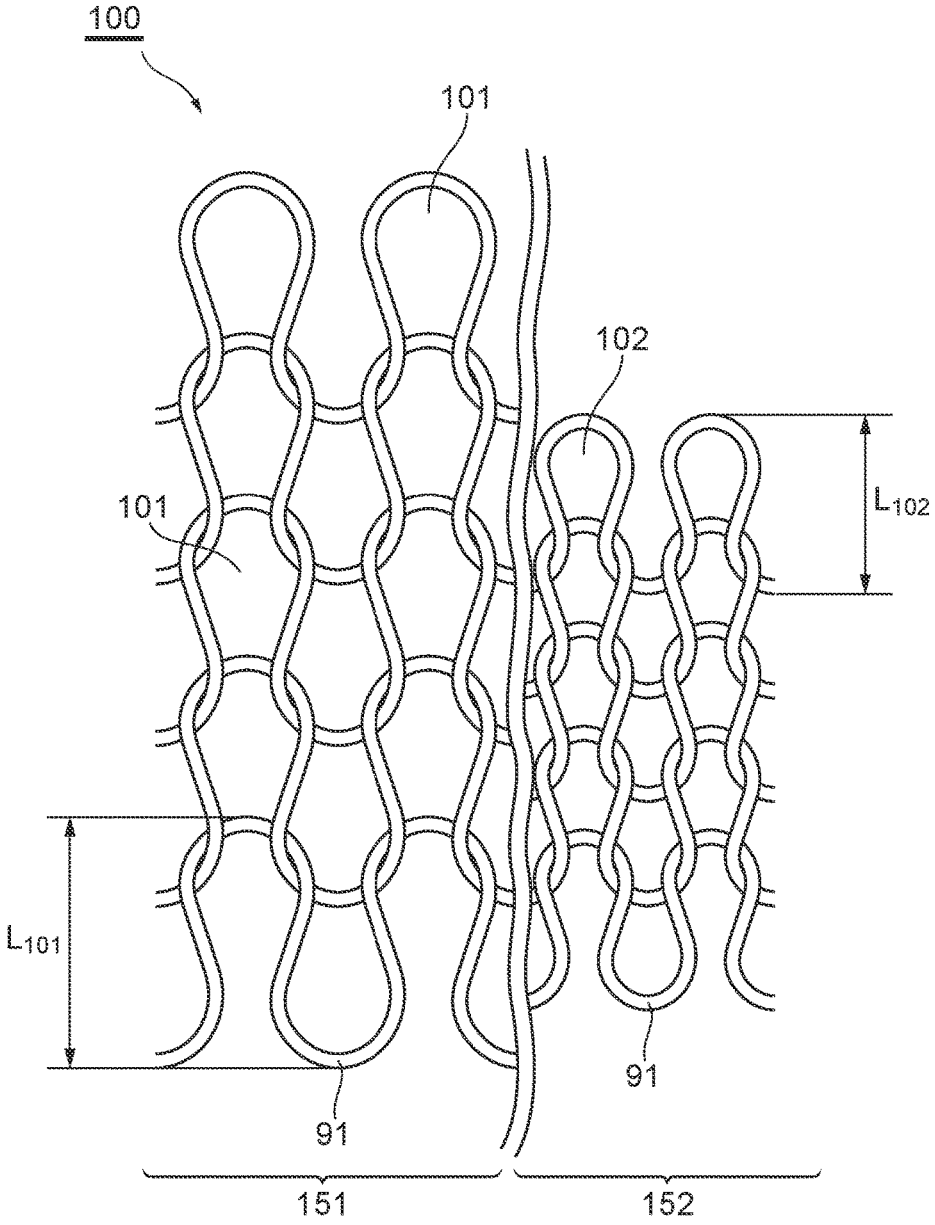
FIG. 1 shows a knitted fabric according to a first preferred embodiment of the present invention.

Hereinafter, preferred embodiments of the present invention are described, referring to FIGS. 1 through 8 in which the same reference signs refer to the same or equivalent elements. Please note that the dimension ratio is not coincident with that in the description. In the description, the term describing the direction such as "upper", "lower" or the like is used for convenience based on the state shown in the drawings.

A stitch-size controlled knitted fabric according to the first preferred embodiment of the present invention will now be described. The knitted fabric includes a plurality of stitches the sizes of which are controlled. FIG. 1 shows the knitted fabric 100 of the first preferred embodiment including a plurality of stitches of different stitch sizes. More specifically, the knitted fabric 100 includes a first stitch 101 and a second stitch 102 having a smaller stitch size than that of the first stitch 101. The knitted fabric 100 includes a first-stitch region 151 defined by the first stitch 101 and a second-stitch region 152 defined by the second stitch 102. The elongation difference between the first-stitch region 151 and the second-stitch region 152 preferably is from about 20% to about 100% in this example.

The yarn count of (a face yarn) knitting yarn 91 preferably corresponds to a cotton count larger than 10, that is, the face yarn preferably is finer than No. 10 cotton, for example. The difference of the stitch size between the first stitch 101 and the second stitch 102, i.e., ($L_{101}$-$L_{102}$) preferably is from about 0.1 mm to about 2.0 mm, for example, where the size of the first stitch 101 is $L_{101}$ and the size of the second stitch 102 is $L_{102}$, as shown in FIG. 1. It is preferable that the yarn count of the knitting yarn 91 corresponds to a cotton count between 30 and 80 in this example.

A circular knitting machine for forming the stitch-size controlled knitted fabric 100 will now be described with respect to FIGS. 2A and 2B. The circular knitting machine for forming the knitted fabric 100 is arranged to knit a plurality of stitches having different stitches by moving sinkers 120 in and out of between reciprocating knitting needles. The second stitch 102 of the knitted fabric 100 is formed by selectively driving the sinkers and placing the knitting yarn on the selected sinker. The selective driving of the sinkers 120 enables the stitch sizes to be controlled.

For example, a single cylinder K type knitting machine which includes a cylinder of 4-inch outer diameter and 240 knitting needles can be used as the circular knitting machine for knitting a sock. However, the outer diameter of the cylinder which is arranged to hold the knitting needles is not limited to 4 inches, but can be selected in accordance with the application of tubular knitted fabric for clothing which is knitted by that knitting machine. The knitting needles are arranged on the cylinder at a density from 14 to 24 per inch in a circumferential direction of the cylinder.

Figure 2A:
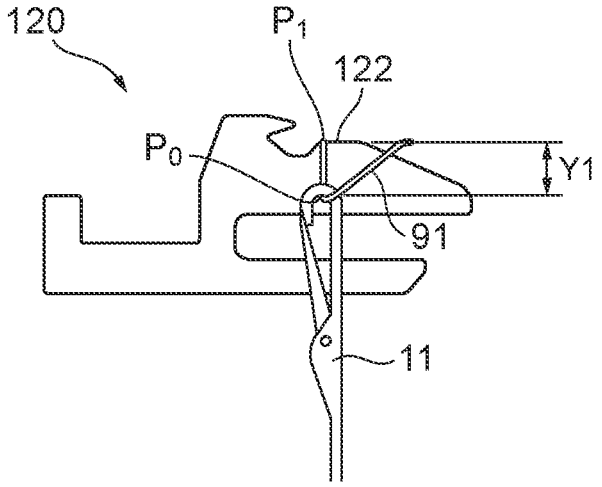
FIGS. 2A and 2B are side views of a two-step sinker in the first preferred embodiment of the present invention, showing the height difference between positions where knitting yarn is held.
Figure 2B:
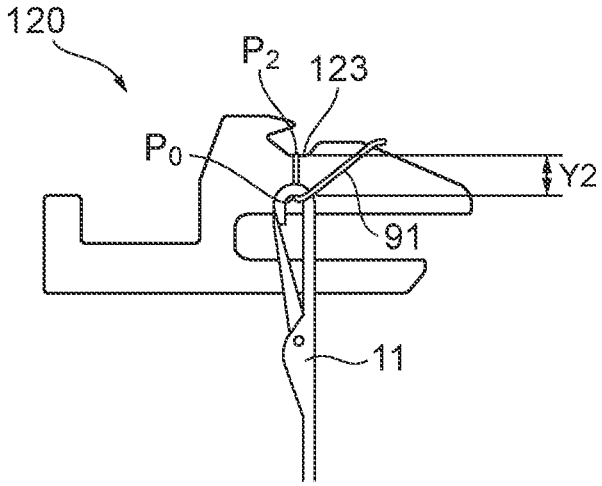

As shown in FIG. 2A, the stitch size of the first stitch 101 corresponds to a distance Y1 from a contact point $P_1$ between the knitting yarn 91 and a sinker 120 (a first sinker top 122) to a contact point $P_0$ between the knitting yarn 91 and a knitting needle 11. As shown in FIG. 2B, the stitch size of the second stitch 102 corresponds to a distance Y2 from a contact point $P_2$ between the knitting yarn 91 and the sinker 120 (a second sinker top 123) to the contact point $P_0$ between the knitting yarn 91 and the knitting needle 11. By individually selecting which one of the sinkers 120 is to be moved forward and backward, it is possible to change the position of the sinker 120 on which the knitting yarn 91 is placed and to selectively arrange either one of small and large stitches on a stitch-by-stitch basis.

In a case of forming the second stitch, an actuator (not shown) which is electronically controllable is used to select a corresponding one of the sinkers 120 individually. The selected sinker 120 is moved forward via a cam to cause the knitting yarn 91 to be placed on the second sinker top 123. In a case of forming the first stitch, the actuator is not operated and any one of the sinkers 120 is not moved forward. In this manner, the knitting yarn 91 is placed on the first sinker top 122.

In a case of arranging any of stitches of different stitch sizes on a stitch-by-stitch basis, a portion having a smaller stitch size than another portion is finer in stitches and therefore the knitting yarn is arranged closer to each other. Thus, in the knitted fabric, an elongation difference can be provided between the first-stitch region defined by the first stitches and the second-stitch region defined by the second stitches. The second stitch having a smaller stitch size has lower elongation than the first stitch having a larger stitch size and therefore a fastening power of the second stitch is larger. The second-stitch region defined by the second stitch is also preferably applied in a compression region described later.

It is desirable that the material for the knitting yarn be yarn formed by texturing a man-made fiber such as nylon and polyester to have elastic property to some extent, e.g., wooly textured yarn.

In the above-described knitted fabric (i.e., the stitch-size controlled knitted fabric), a compression region can be formed at a desired position to have a desired area, while a single stitch is regarded as the smallest unit.

For example, it is possible to form the compression region partially in the knitted fabric at a position which should be compressed, such as a pressure point or a muscle. Therefore, a value-added knit product can be obtained. The first-stitch region is formed at a portion where the pressure is not to be applied, whereas the second-stitch region is formed at a portion where the pressure is to be applied. Thus, it is possible not to compress a portion of a human body which should not be compressed medically, for example.

Moreover, the compression region preferably includes knitting structures. Therefore, while the elongation of the knitting structure is obtained and the wearing comfort as is reliably maintained, a partial compression effect can be provided by a tension difference.

In addition, the aforementioned knitted fabric preferably has a substantially constant thickness. Therefore, a knit product made of that knitted fabric cannot cause a person wearing that knit product to have a feeling of strangeness that something exists. Also, inserted yarn cannot protrude from a skin-side surface of the knitted fabric. Therefore, it is unlikely that the skin is damaged. Moreover, it is possible to prevent an unnecessary portion of a human body from being compressed. Therefore, the aforementioned knitted fabric cannot carelessly stimulate the sympathetic nerve system of a person wearing a knit product made from that knitted fabric. Furthermore, in the stitch-size controlled knitted fabric 100, it is unlikely that cut yarn tail projects therefrom. Therefore, the appearance of the knitted fabric cannot be damaged.

In the knitted fabric 100 including stitch-size controlled stitches, the knitting yarn is continuous. Therefore, as compared with a conventional partial compression product, it is possible to reduce the used amount of knitting yarn, thus enabling the production efficiency to be improved. Moreover, in the stitch-size controlled fabric 100, the knitting yarn is continuous. Therefore, as compared with a conventional partial compression product, the appearance cannot be damaged by projection of cut yarn tale, for example, thus improving the strength of the fabric.

Figure 3:
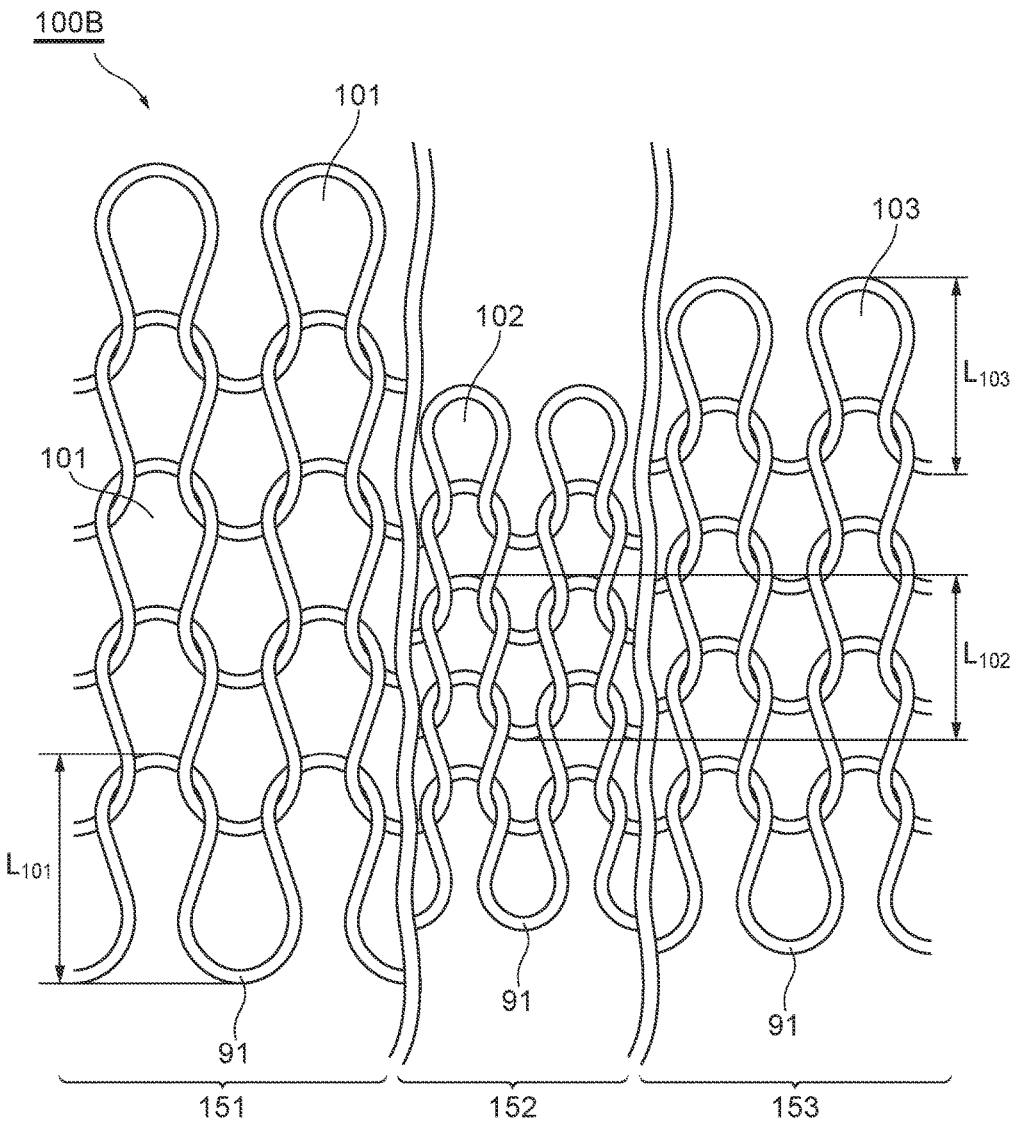
FIG. 3 shows a knitted fabric according to a second preferred embodiment of the present invention.

Next, a knitted fabric according to the second preferred embodiment of the present invention is described. The same description as that described for the first preferred embodiment is omitted. FIG. 3 shows the knitted fabric 100B according to the second preferred embodiment. The knitted fabric 100B shown in FIG. 3 includes as a plurality of stitches a first stitch 101, a second stitch 102 having a stitch size smaller than the first stitch 101, and a third stitch 103 having a stitch size smaller than the first stitch 101 and larger than the second stitch 102. That is, the stitch sizes of the first, second, and third stitches are set to become larger in the order of the second stitch, the third stitch, and the first stitch.

The knitted fabric 100B includes a first-stitch region 151 defined by the first stitch 101, a second-stitch region 152 defined by the second stitch 102, and a third-stitch region 153 defined by the third stitch 103. The elongation difference between the first-stitch region 151 and the second stitch-region 152 preferably is from about 20% to about 100%, for example. The stitch-size difference between the first stitch 101 and the second stitch 102, i.e., ($L_{101}$-$L_{102}$) preferably is about 0.1 mm to about 2.0 mm, for example, where $L_{101}$ is the stitch size of the first stitch 101 and $L_{102}$ is the stitch size of the second stitch 102. Moreover, the third stitch 103 has a stitch size of $L_{103}$, as shown in FIG. 3.

Figure 4A:
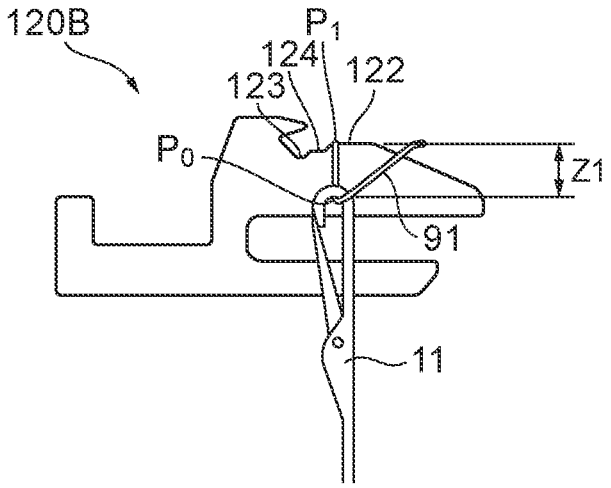
FIGS. 4A, 4B, and 4C are side views of a three-step sinker in the second preferred embodiment of the present invention, showing the height difference between positions where knitting yarn is held.
Figure 4B:
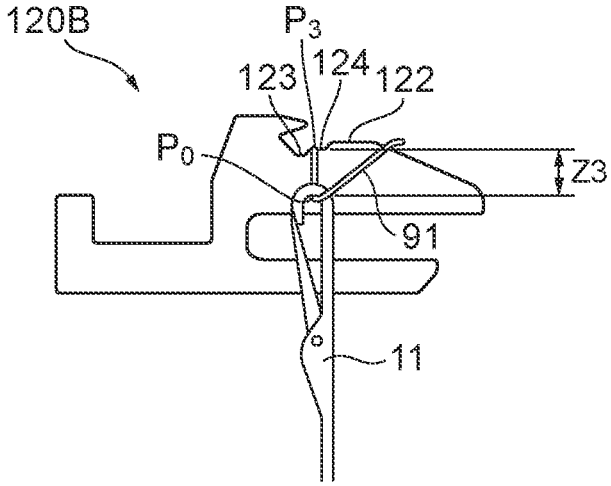
Figure 4C:
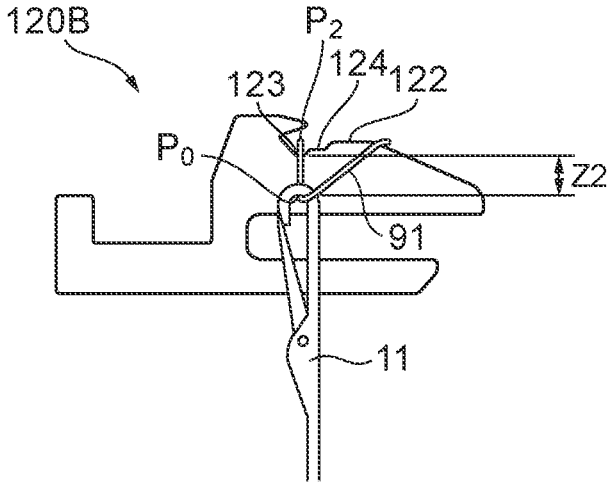

As shown in FIG. 4A, the stitch size of the first stitch 101 corresponds to a distance Z1 from a contact point $P_1$ between a knitting yarn 91 and a sinker 120B (a first sinker top 122) to a contact point $P_0$ between the knitting yarn 91 and a knitting needle 11. As shown in FIG. 4B, the stitch size of the third stitch 103 corresponds to a distance Z3 from a contact point $P_3$ between the knitting yarn 91 and the sinker 120B (a third sinker top 124) to the contact point $P_0$ between the knitting yarn 91 and the knitting needle 11. As shown in FIG. 4C, the stitch size of the second stitch 102 corresponds to a distance Z2 from a contact point $P_2$ between the knitting yarn 91 and the sinker 120B (a second sinker top 123) to the contact point $P_0$ between the knitting yarn 91 and the knitting needle 11. In this manner, by individually selecting which one of the sinkers 120B is to be moved forward and backward, it is possible to change the position of the sinker 120B on which the knitting yarn 91 is to be placed and to selectively arrange any one of stitches having the large stitch size, the medium stitch size, and the small stitch size on a stitch-by-stitch basis.

Figure 5:
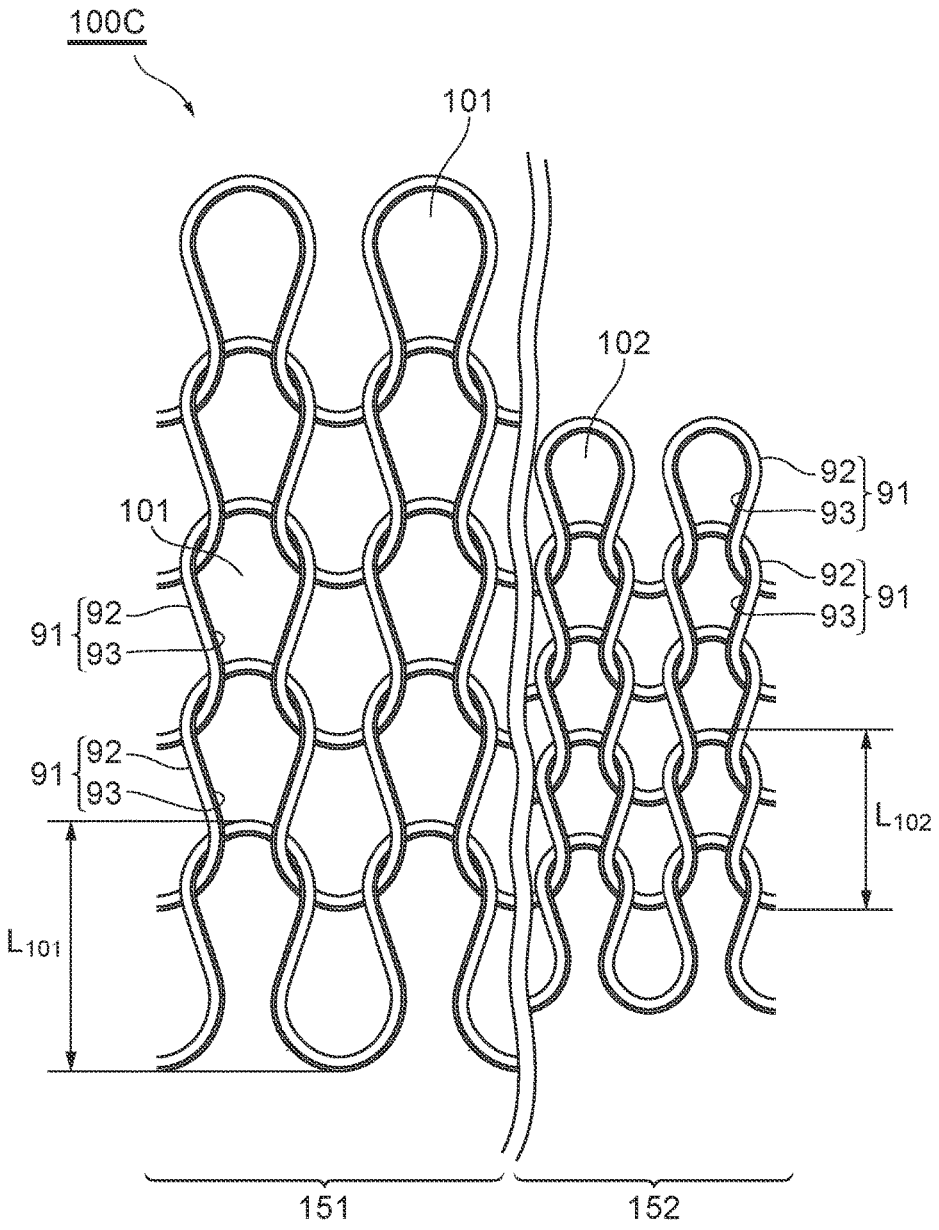
FIG. 5 shows a knitted fabric according to a third preferred embodiment of the present invention.

A knitted fabric according to a third preferred embodiment of the present invention will now be described. The same description as that described above is omitted. FIG. 5 shows the knitted fabric 100C according to the third preferred embodiment. The knitted fabric 100C includes a first stitch 101 and a second stitch 102, as shown in FIG. 5. A knitting yarn 91 forming the stitches 101 and 102 of the knitted fabric 100C includes a face yarn 92 and a back yarn 93.

The yarn count of the face yarn 92 of the knitting yarn of the knitted fabric 100C preferably corresponds to a cotton count larger than 10, i.e., the face yarn 92 preferably is finer than No. 10 cotton, for example. The back yarn 93 of the knitting yarn of the knitted fabric 100C preferably is a covering yarn having a core yarn of polyurethane of about 70 denier or less or a man-made fiber of about 140 denier or less which is subjected to texturing, for example. The stitch size difference between the first stitch 101 and the second stitch 102 preferably is from about 0.1 mm to about 2.0 mm, for example. It is preferable that the yarn count of the face yarn 92 correspond to a cotton count between 30 and 80, for example. Also, it is preferable that the back yarn 93 be a covering yarn having a core yarn of polyurethane of about 40 denier, for example. Alternatively, the back yarn 93 is preferably a man-made fiber of about 70 denier to about 110 denier subjected to texturing.

The stitch size difference ($L_{101}$-$L_{102}$) between the first stitch 101 and the second stitch 102 preferably is from about 0.1 mm to about 2.0 mm, for example, where $L_{101}$ is the stitch size of the first stitch 101 and $L_{102}$ is the stitch size of the second stitch 102 shown in FIG. 5.

Figures 6A, 6B, 6C, 6D:
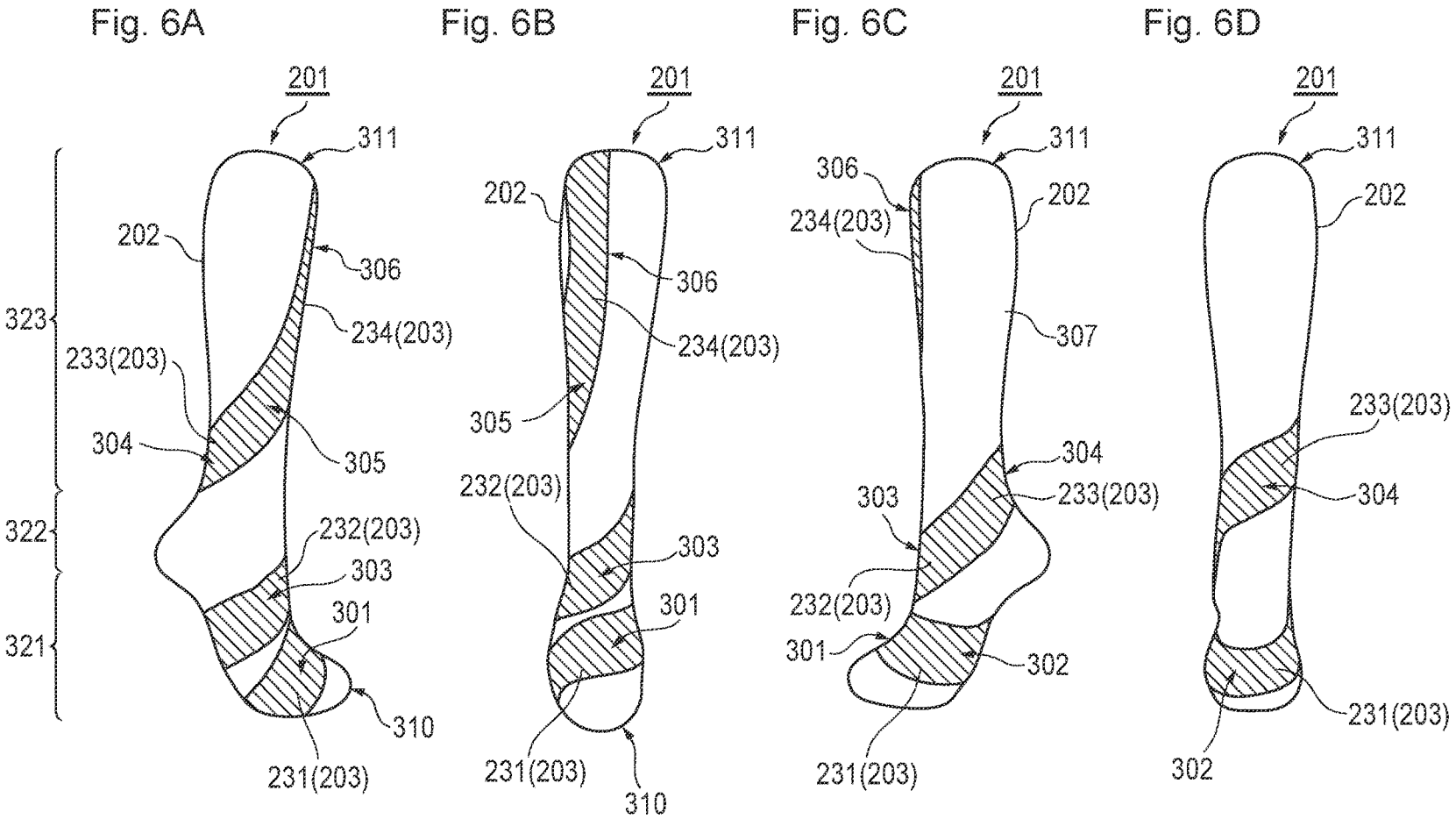
FIGS. 6A, 6B, 6C and 6D show a compression sock (e.g., for a right foot) of Example 1 according to a preferred embodiment of the present invention.

Next, a compression sock of Example 1 according to a preferred embodiment of the present invention is described referring to FIGS. 6A, 6B, 6C, and 6D. FIGS. 6A to 6D show the compression sock of Example 1. FIG. 6A is an outer side view, FIG. 6B is a front view, FIG. 6C is an inner side view and FIG. 6D is a back view.

The compression sock (compression spiral sock) 201 shown in FIGS. 6A to 6D preferably includes a tubular body portion 202 and a support line 203 (compression region) located in the tubular body portion 202. The support line 203 has a stronger fastening force than around the support line 203 and can compress a lower leg and a foot by the fastening force thereof to improve blood circulation and prevent swelling. Also, the compression sock 201 has an effect of making a leg of a person who wears the compression sock 201 look slender.

The body portion 202 is preferably arranged to extend from a toe 310 to a kneecap's lower end 311 to entirely cover a lower leg portion 323, an ankle 322, and a foot 321. That is, the body portion 202 is preferably arranged to cover a toe, an instep, a sole, an ankle, a heel, a shin, a calf and a kneecap's lower end of a person who wears the sock 201. The fabric of the body portion 202 preferably is knitted fabric having an elastic property and defined by plain stitches as the first stitches 101 (see FIG. 1), for example.

In the compression sock 201 of Example 1, a difference in compression strength is provided on the same circumference. Please note that the compression strength represents the magnitude of a force applied by the body portion 202 to compress a portion of a body of a person who wears the sock 201. Portions of the sock 201 which have a remarkable effect of decreasing the volume by compression are an ankle ventral portion 303 and an arch 302. Therefore, the compression sock 201 is arranged to compress the ankle ventral portion 303 and the arch 302 not by a fastening member arranged along the same circumference, but by the support line (compression belt) 203 arranged spirally.

The support line 203 is now described. The support line 203 includes a compression belt having a stronger fastening force as compared with that around the support line 203, and has a structure that appropriately compresses a portion of a body of a person with which the support line 203 is in contact, while the compression sock 201 is worn by the person.

The support line 203 preferably is a belt-shaped portion in which the fastening force is enhanced by suppressing the elastic property, and is preferably integral with the fabric of the body portion 202. The support line 203 is preferably defined by the second stitch (i.e., the stitch having small stitch size) 102 in this example. By arranging the first stitch 101 and the second stitch 102 in the same course, a difference in the compression strength on the same circumference is provided. It is preferable that, while no pressure is generated, the support line (belt-shaped portion) has a width of about 3.5 cm to about 5.0 cm, for example.

The tubular body portion 202 is the first-stitch region defined by the first stitch 101 only, and the support line 203 is the second-stitch region defined by the second stitch 102 only. The elongation difference between the body portion 202 (the first-stitch region) and the support line 203 (the second-stitch region) preferably is about 20% to about 100%, for example. For example, the body portion 202 preferably has elongation of about 150% and the support line 203 preferably has elongation of about 70%, for example. The elongation is represented by the following equation:

Elongation (%)=[(the fabric length when 3.5 kg-weight is applied−the fabric length when no weight is applied)/the fabric length when no weight is applied]×100

It should be noted that the fabric length is the length of the knitted fabric.

The support line 203 is preferably arranged to satisfy the following conditions. First, the support line 203 is preferably arranged, in the form of a spiral, to cover portions of a body of a person so that the support line 203 does not directly compress the great saphenous vein, the saphenous nerve, and the lateral sural cutaneous nerve.

Second, the support line 203 is preferably arranged to compress the ankle ventral portion 303 in a plane. Because the great saphenous vein and the saphenous nerve run through the ankle ventral portion 303, too, the vein and the nerve are directly compressed if the support line 203 is arranged at the ankle ventral portion 303. Therefore, it is preferable to compress the ankle ventral portion 303 in a plane that prevents the fabric from digging into a body of a person.

Third, the support line 203 is preferably arranged not to cross the great saphenous vein running inside (central side of a body of a person) the tibia, the saphenous nerve, the short saphenous vein running into belly muscle of the gastrocnemius muscle, and the lateral sural cutaneous nerve to the extent possible.

Fourth, the support line 203 is preferably arranged in the form of a spiral extending from a toe to a knee. The spiral is involuted with respect to an axial direction of the leg.

More specifically, the support line 203 is preferably arranged to include a first fastening portion 231, a second fastening portion 232, a third fastening portion 233, and a fourth fastening portion 234. The first fastening portion 231 is preferably arranged to extend from a position corresponding to the plantar portion of the third or fourth metatarsal to the instep 301 through the foot outside and from the instep 301 to the arch 302 through the foot inside. The second fastening portion 232 preferably is continuously arranged with the first fastening portion 231 to extend from the outside to the inside obliquely upward in the ankle ventral portion 303. The third fastening portion 233 preferably is arranged continuously with the second fastening portion 232 to cover the muscle tendon junction connecting the Achilles tendon and the triceps surae muscle to each other. The fourth fastening portion 234 preferably is arranged continuously with the third fastening portion 233 to extend from a lower-leg lateral portion 305 to a lower-leg ventral portion 306 obliquely upward and reach a ventral portion of the kneecap's lower end. The support line 203 is defined by the fastening portions 231 to 234 that are preferably continuously arranged in the aforementioned manner in the form of an involuted spiral.

Further specifically, the first fastening portion 231 extends from a portion corresponding to the plantar portion of the third or fourth metatarsal. The first fastening portion 231 is rolled up to the outside; runs toward the ventral side while covering the proximal phalanx of the fifth toe and the top and body of the fifth metatarsal; passes through a position corresponding to the body of the first metatarsal; and reaches the arch 302. The first fastening portion 231 extends toward the ventral side while covering the arch 302 and the tuberosity of the fifth metatarsal, and is continuous with the second fastening portion 232. Because nerves and blood vessels are protected by bones in the instep 301, the instep 301 is allowed to be compressed by the first fastening portion 231. The plantar vein (sole) which can easily swell is compressed by the first fastening portion 231.

The second fastening portion 232 is preferably arranged to extend from the outside to the inside obliquely upward, cover the ankle ventral portion 303 and be continuous with the third fastening portion 233. The ankle ventral portion 303, which is softer and can be more easily damaged as compared with other body portions, is compressed by the second fastening portion 232 in a plane. The fastening portion 232 is arranged to be more wrinkle-resistant.

The third fastening portion 233 extends through an upper portion of an inner ankle and is rolled up in an upper portion of the Achilles tendon obliquely upward. The third fastening portion 233 is preferably arranged to extend, in an upper portion of the back of the ankle (a lower portion of the back of the lower leg), from the inside to the outside obliquely upward, cover the muscle tendon junction 304 connecting the triceps surae and the Achilles tendon to each other and be continuous with the fourth fastening portion 234. The gastrocnemius muscle which can easily swell is compressed and pulled upward by the third fastening portion 233. The triceps surae refers to a portion including a gastrocnemius-soleus muscle group.

The fourth fastening portion 234 is preferably arranged to extend from the lower-leg lateral portion 305 to the lower-leg ventral portion 306 obliquely upward and reach the ventral portion of the kneecap's lower end. The fourth fastening portion 234 is preferably arranged to cover the lower-leg lateral portion 305, the lower-leg ventral portion 306 and the ventral portion of the kneecap's lower end. In other words, the fourth fastening portion 234 runs through the center of the outside of the corpus fibulae obliquely upward in the order of the belly muscle of the short gastrocnemius muscle, the belly muscle of the long gastrocnemius muscle and the belly muscle of the tibialis anterior muscle, and is rolled up toward the kneecap on the ventral side. The fourth fastening portion 234 is pulled up along the movement of the gastrocnemius muscle and pulls up the third fastening portion 233 continuous with the fourth fastening portion 234, so that portions of a person's body other than the gastrocnemius muscle can work with the movement of the gastrocnemius muscle. In addition, the fourth fastening portion 234 is not arranged in the inside 307 of the lower leg, through which the great saphenous vein and the saphenous nerve run, to prevent the great saphenous vein and the saphenous nerve from being compressed.

Because the support line 203 is arranged to correspond to positions of bones and muscles of a person who wears the sock, portions of right and left legs are compressed in a symmetrical manner. The widths of the first to fourth fastening portions 231 to 234 may be the same or be changed appropriately depending on which portion of the person's leg is to be compressed. For example, the fastening forces applied to the respective portions of the leg can be adjusted by appropriately changing the widths of the first to fourth fastening portions 231 to 234.

It is preferable that the support line 203 be arranged to extend from the ankle ventral portion 303 to the base of the little toe through the instep 301.

Next, an operation of the compression sock 201 is described. While being worn by a person, the compression sock 201 is in close contact with the body portions of the person and compresses the body portions in a suitable manner. The compression sock 201 assists the blood flow and the lymph flow from the toe to the lower leg and the thigh by a change in the compression force applied by the spiral support line 203. In general, when a person continues to stand or sit without changing his/her position, the leg swelling increases. However, the compression sock 201 can have an effect of reducing the swelling even while a person wearing the compression sock 201 hardly moves. Moreover, in a case where the person moves, the effect of reducing the swelling of the leg provided by the compression sock 201 is further enhanced.

According to the compression sock 201, it is possible to select either one of the large stitch size and the small stitch size on a stitch-by-stitch basis and to suitably arrange the compression region (support line 203) by selective driving of the sinkers.

The compression sock 201 is preferably arranged to include the knitted fabric of the preferred embodiment. Thus, the compression region is located at a desired position to have a desired area, while a single stitch is regarded as the smallest unit. In the compression sock 201, the first-stitch region is located at a portion to which the clothing pressure is not to be applied and the second-stitch region is located at a portion to which the clothing pressure is to be applied.

Thus, it is possible to prevent the clothing pressure from being applied to a portion which should not be compressed in general.

In the compression sock 201, the compression region includes knitting structures. Therefore, the compression sock 201 has elongation of knitting. Also, the compression sock 201 can provide a partially compressing effect because of the tension difference while the comfort as a knit product is kept.

Moreover, the compression sock 201 preferably has a substantially constant thickness of the knitted fabric. Therefore, a person wearing the compression sock 201 does not have a feeling of strangeness that something exists. Also, the skin of the person wearing the compression sock 201 cannot be damaged because inserted yarn does not project from the skin-side surface. In addition, it is possible to prevent the clothing pressure from being applied to an unnecessary portion. Therefore, it is possible to prevent the sympathetic nerve system of the person wearing the compression sock 201 from being stimulated carelessly. Furthermore, in the compression sock 201 including the stitch-size controlled knitted fabric, it is unlikely that cut yarn tail projects from the knitted fabric. Therefore, the appearance of the compression sock 201 cannot be damaged.

In the compression sock 201 including the stitch-size controlled knitted fabric, the knitting yarn is continuous. Therefore, it is possible to reduce the used amount of the knitting yarn as compared with a conventional compression product, thus enabling improvement of production efficiency. Moreover, in the stitch-size controlled knitted fabric 100, the knitting yarn is continuous. Therefore, as compared with a conventional compression product, it is less likely that the appearance of the knitted fabric is disfigured by projecting cut yarn tail, for example, and it is possible to improve the strength of the fabric.

Figure 7:
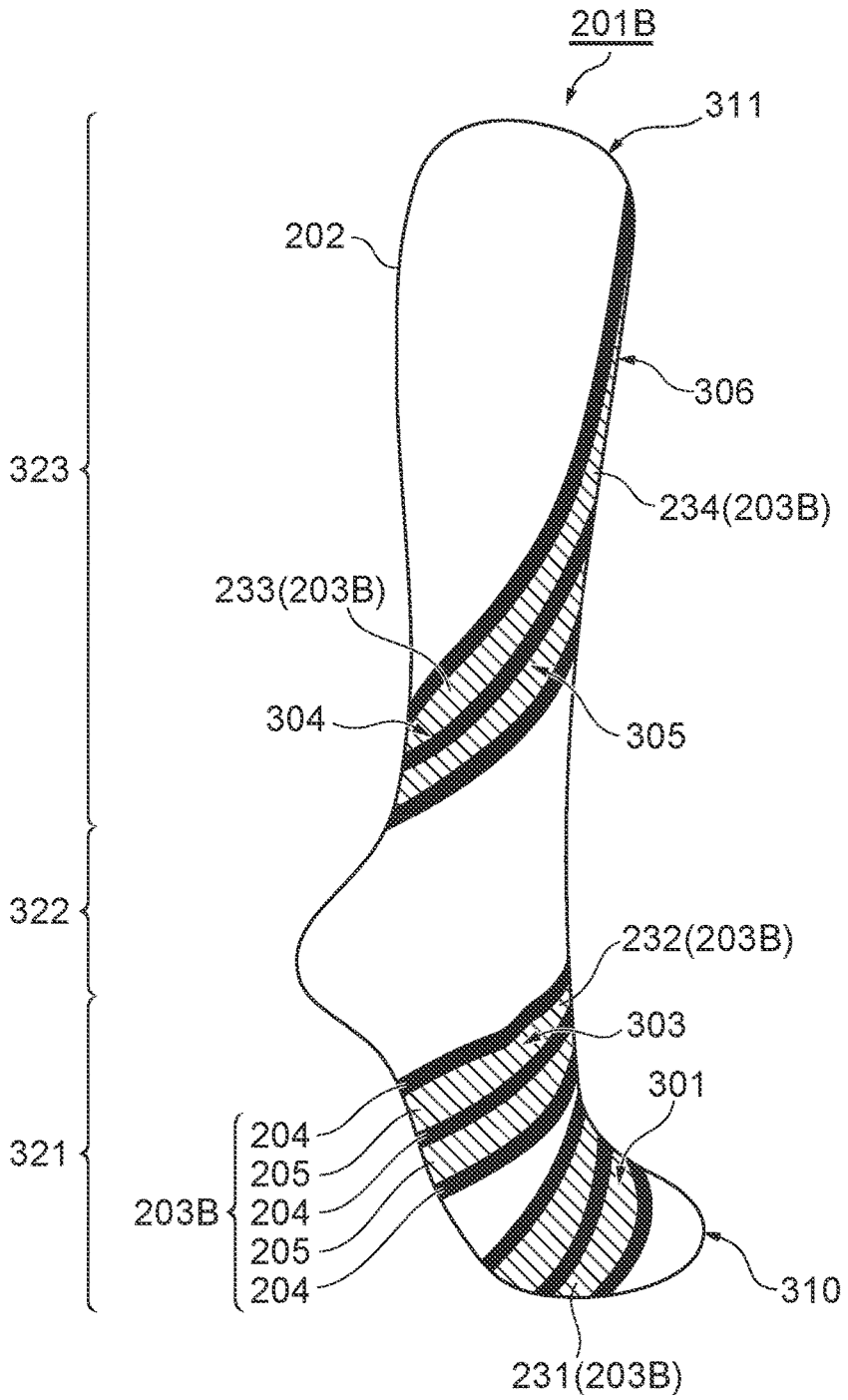
FIG. 7 shows a compression sock (e.g., for a right foot) of Example 2 according to a preferred embodiment of the present invention.

Next, a compression sock of Example 2 according to a preferred embodiment of the present invention is described. FIG. 7 shows the compression sock of Example 2. The compression sock 201B shown in FIG. 7 is different from the compression sock 201 shown in FIGS. 6A to 6D in that a support line 203B of the compression sock 201B is defined by a plurality of stitches having different size stitches.

The support line 203B includes a second-stitch region 204 defined by the second stitch 102 only and a third-stitch region 205 defined by the third stitch 103 only. The second-stitch region 204 and the third-stitch region 205 are alternately arranged in the width direction of the support line 203B, i.e., a direction crossing a longitudinal direction of the support line 203B. Therefore, it is possible to form a stripe in the support line 203B, for example.

Figure 8:
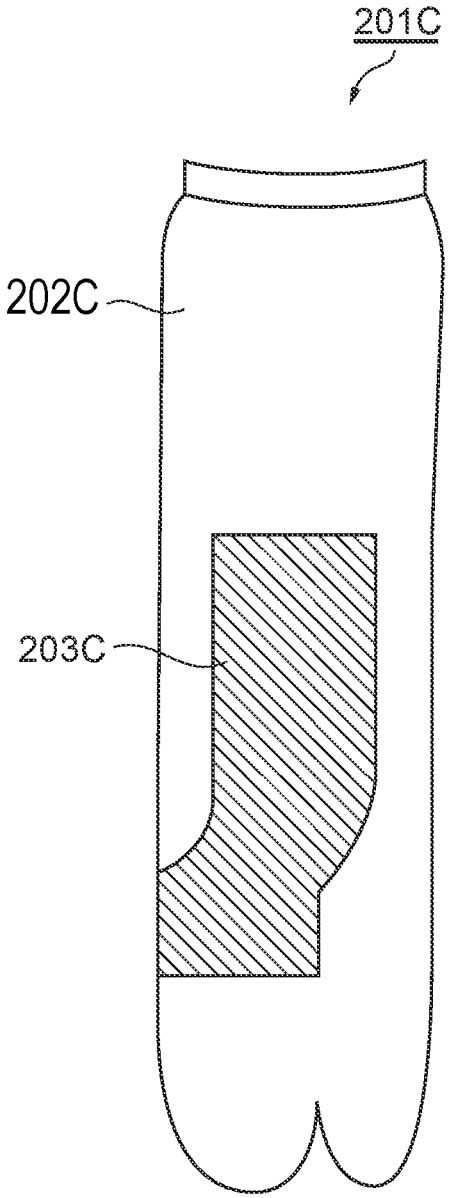
FIG. 8 shows a tripping-prevention sock of Example 3 according to a preferred embodiment of the present invention.

Next, a tripping-prevention sock of Example 3 according to a preferred embodiment of the present invention is described. FIG. 8 shows the tripping-prevention sock of Example 3. The tripping-prevention sock 201C shown in FIG. 8 preferably includes a tubular body portion 202C and a compression region 203C formed in the body portion 202C. The compression region 203C has a stronger fastening force than around the compression region 203C. The compression region 203C is arranged to extend from a portion around the top of the fifth toe through the instep and then reach the ankle-ventral portion. In the instep, the compression region 203C extends along the center of the foot in the foot-width direction (the vertical direction in FIG. 8). In the toe, the compression region 203C is arranged in the outer portion in the foot-width direction.

The fabric of the body portion 202C has an elastic property and is defined by a first-stitch region defined by the first stitch 101 only. The compression region 203C has a stronger fastening force than around the compression region 203C and is defined by a second-stitch region defined by the second stitch 102 only.

In this tripping-prevention sock 201C, the compression region 203C is defined by the second stitch 102 and is arranged to extend from around the base of the fifth toe through the instep and reach the ankle-ventral portion. Therefore, the top and the portion around an area of the fifth toe can be lifted upward. Therefore, a toe position can be adjusted so that the toe of the foot is lifted obliquely upward, thus preventing falling of a person wearing this tripping-prevention sock 201C.

In the above, the preferred embodiments and the examples of the present invention are described in detail. However, the present invention is not limited thereto. For example, although the support line preferably is continuously arranged from the toe to the portion under knee in the above preferred embodiments, the support line can be defined by a plurality of separate components (compression regions). Also, the support line is arranged to be divided and/or connected.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A stitch-size controlled knit product formed by a circular knitting machine capable of forming a plurality of stitches having different stitch sizes in a same course on a circumference by moving sinkers in and out of between reciprocating knitting needles, the plurality of stitches including a first stitch and a second stitch having a smaller stitch size than the first stitch, the circular knitting machine being capable of selectively arranging the second stitch on a stitch-by-stitch basis, the knitting needles being arranged on a cylinder of the circular knitting machine at a density from about 14 to about 24 per inch in a circumferential direction of the cylinder; wherein a yarn count of a face yarn of a knitting yarn defining the stitches corresponds to a cotton count larger than 10;

a difference of the stitch size between the first stitch and the second stitch is from about 0.1 mm to about 2.0 mm; and an elongation difference between a first-stitch region defined by the first stitch only and a second-stitch region defined by the second stitch only is from about 20% to about 100%.

2. A stitch-size controlled knit product according to claim 1, wherein the yarn count of the face yarn corresponds to a cotton count between 30 and 80.

* * * * *